United States Patent [19]

Trombley

[11] 3,980,117

[45] Sept. 14, 1976

[54] CONTAINER FOR A DISPOSABLE JAR

[76] Inventor: Bertrand N. Trombley, 1100 N. Woodward, Birmingham, Mich. 48011

[22] Filed: Sept. 4, 1975

[21] Appl. No.: 610,117

[52] U.S. Cl. ..... 150/52 R; 215/200; 215/13 R; 220/17

[51] Int. Cl.[2] ..... B65D 23/08

[58] Field of Search ..... 215/13 R, 12 R, 305, 215/200; 220/17; 150/.5, 52 R

[56] References Cited

UNITED STATES PATENTS

| | | | |
|---|---|---|---|
| 2,177,540 | 10/1939 | Steenstrup | 220/17 X |
| 2,507,425 | 5/1950 | Swartout | 220/17 X |
| 2,692,703 | 10/1954 | Bramming | 215/13 R UX |
| 2,897,996 | 8/1959 | Billig | 220/17 |
| 3,164,285 | 1/1965 | Melich | 220/17 |
| 3,779,298 | 12/1973 | Piccirilli | 215/13 R X |

FOREIGN PATENTS OR APPLICATIONS

| | | | |
|---|---|---|---|
| 330,940 | 12/1920 | Germany | 215/13 R |

*Primary Examiner*—Donald F. Norton
*Attorney, Agent, or Firm*—Harness, Dickey & Pierce

[57] ABSTRACT

An attractive container made of opaque colored material is constructed to receive a jar with a product which is unattractive containing labels and a removable cover which likewise could contain advertisement. The label, advertisement and unattractive jar prevents it from being placed on the table for a formal meal. By removing the cover and placing the jar within the container of the present invention an attractive unit is provided for dispensing the product contained within the jar.

2 Claims, 3 Drawing Figures

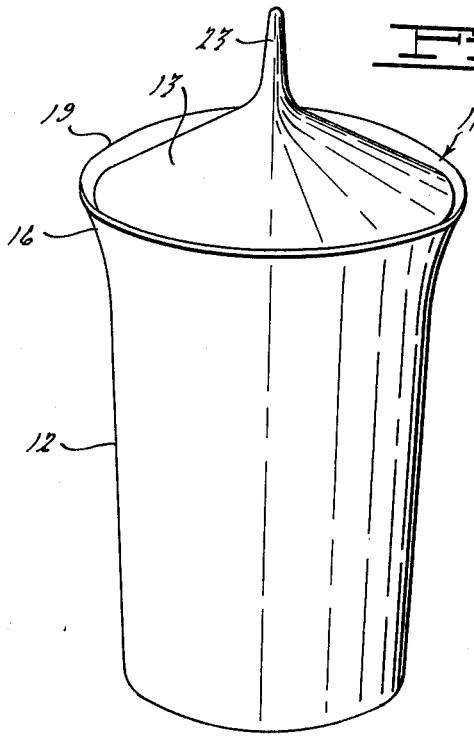
FIG. 1.
FIG. 2.
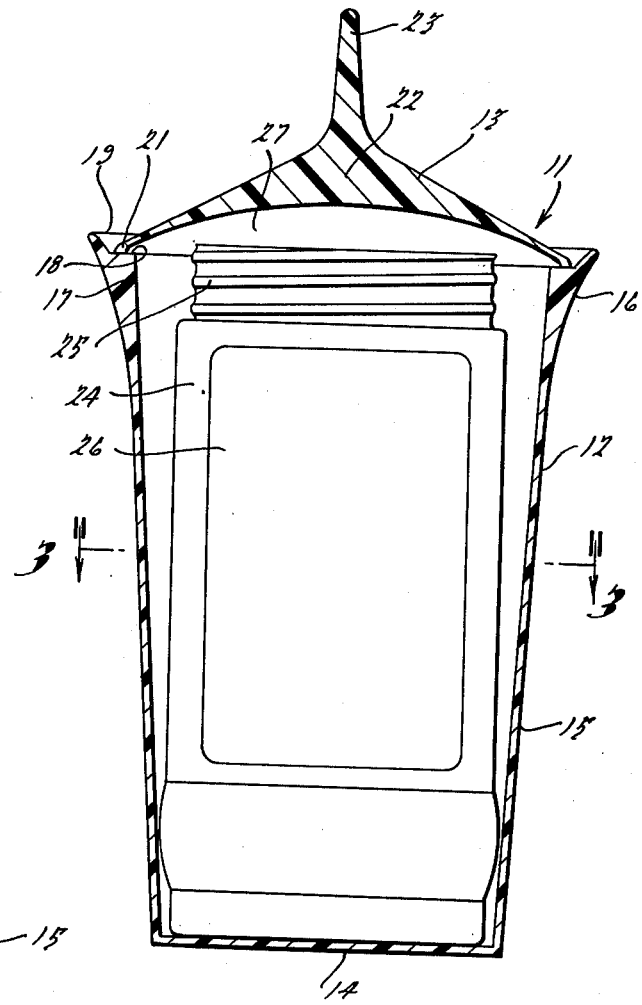
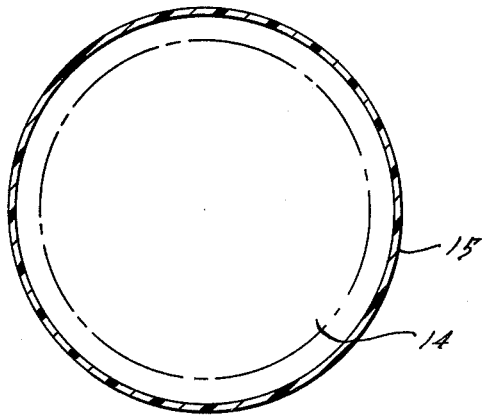
FIG. 3.

CONTAINER FOR A DISPOSABLE JAR

SUMMARY OF THE INVENTION

The invention pertains to a container which follows the shape of the jar which is to be placed therein and which is usually of cylindrical form. The wall of the container slightly tapers outwardly from the bottom and is provided at the top opening with a bell mouth of substantially thicker material. The material forms a ledge for a cover which extends within the mouth a short distance located within an outer extension of the ledge. The material also strengthens the bell-shaped mouth to prevent cracking which otherwise might occur if the wall thickness is the same throughout the height of the container. The container and cover are preferably molded form like plastic material such as impact polyethylene, colored polyethylene, polypropylene and the like. Providing a material of proper colored density the label and the jar are not visible so that the product within the jar is available while being served in an attractive container. A minimum amount of air space is present between the container and jar so as to prevent the product from deteriorating. A product such as jam, jelly, pickles and the like may be served within the container in this fashion. When the jar is empty, it may be disposed of and a new jar employed in its place containing the same or a different product.

BRIEF DESCRIPTION OF THE DRAWING

FIG. 1 is a view of a container with the lid thereon embodying features of the present invention;

FIG. 2 is a sectional view of the container illustrated in FIG. 1, taken through the centerline thereof and containing a jar, and FIG. 3 is a sectional view of the structure illustrated in FIG. 2, taken on the line 3—3 thereof.

DESCRIPTION OF THE PREFERRED EMBODIMENT

In the Figures, a container 11 has a body portion 12 and a cover 13 which forms an attractive combination. The body 12 is of tumble shape having a bottom 14, a cylindrical side wall 15 which slightly tapers outwardly from the bottom to the top. The top 16 is of bell shape having a thicker section 17 which forms a ledge 18 with the top container portion 19 extending thereabove and therebeyond. The cover 13 is of flat conical shape having the outer edge 21 substantially thinner than the center 22. The edge of the cover is circular and resting on the ledge 18 to be retained in position by the top container portion 19. The cover has a central upwardly extending projection 23 which may be grasped between the thumb and index fingers when removing the cover from the container.

The container 15 is dimensioned to receive a particular jar 24 for a product which may be a jelly, a jam, pickles or the like with the jar being made of glass and having a thread 25 at the top to which a cover is attached in sealed relation therewith. One or more labels 26 on the jar 24 contains advertising material which may also be found on the cover, both of which would be unattractive on a table which is set for a formal meal.

The container 15 is made of glass or a plastic molding material which is preferably translucent or opaque, containing a desired color of such density as to prevent the jar from being seen therethrough. Impact polystyrene could be employed as well as colored polyethylene or polypropylene or any other readily moldable material through which the jar and label would not be visible. The color 13 may be similarly constructed and could be transparent. The area 27 between the jar and container 15 is maintained at a minimum so that the jar cover can be disposed of and the open jar retained within the container without damage to the product. When the cover 13 is placed upon the ledge 18 a dead air space is provided which prevents the deterioration of the product within the jar. When such product is used up, the jar 24 may be disposed of and a new jar of the same size can be supported within the container 15 for the same or a different product.

What is claimed is:

1. An attractive container and cover for an unattractive disposable jar for a food product, said container being of cylindrical shape which has a slight upward and outward taper to provide a top opening, said opening being of bell shape with the material thickened to provide strength and to form a ledge, a cover of truncated conical shape having a tapered central top projection of small diameter, said ledge having an outer and upward flared portion which centers the cover when the outer edge is engaged thereby.

2. An attractive container and cover for an unattractive disposable jar as recited in claim 1, wherein the space between the container and cover and the jar is of such small amount as to provide a dead air space about the jar.

* * * * *